US009818509B2

(12) United States Patent
Diamanti et al.

(10) Patent No.: US 9,818,509 B2
(45) Date of Patent: Nov. 14, 2017

(54) METHOD OF MANUFACTURE OF PORCELAIN INSULATOR STRUCTURES AND METHOD AND ASSEMBLY FOR AFFIXING METAL FLANGES TO PORCELAIN INSULATORS

(71) Applicant: SIEMENS AKTIENGESELLSCHAFT, Munich (DE)

(72) Inventors: Paolo Diamanti, Maple (CA); Ross McTaggart, Markham (CA); Joseph Arjune, Scarborough (CA)

(73) Assignee: Siemens Aktiengesellschaft, Munich (DE)

( * ) Notice: Subject to any disclaimer, the term of this patent is extended or adjusted under 35 U.S.C. 154(b) by 445 days.

(21) Appl. No.: 14/372,054

(22) PCT Filed: Jan. 14, 2013

(86) PCT No.: PCT/IB2013/000041

§ 371 (c)(1),
(2) Date: Jul. 14, 2014

(87) PCT Pub. No.: WO2013/104983

PCT Pub. Date: Jul. 18, 2013

(65) Prior Publication Data

US 2015/0048919 A1 Feb. 19, 2015

Related U.S. Application Data

(60) Provisional application No. 61/586,171, filed on Jan. 13, 2012.

(51) Int. Cl.
*H01B 17/66* (2006.01)
*H01B 19/02* (2006.01)
(Continued)

(52) U.S. Cl.
CPC ..... *H01B 17/66* (2013.01); *H01B 3/12* (2013.01); *H01B 19/00* (2013.01); *H01B 19/02* (2013.01);
(Continued)

(58) Field of Classification Search
CPC ..... H01B 17/16; H01B 17/66; H01B 19/00; H01B 19/02; H01B 19/04; H01B 3/12; H01F 27/32
(Continued)

(56) References Cited

U.S. PATENT DOCUMENTS 1,873,977 A * 8/1932 Naef ..... H01B 17/28
174/11 BH
2,671,822 A * 3/1954 McMahon ..... H01B 17/20
174/169
(Continued)

FOREIGN PATENT DOCUMENTS

CH EP 2203922 A1 * 7/2010 ..... H01B 17/28
CN 101312085 A 11/2008
(Continued)

OTHER PUBLICATIONS

Eduardo N.B.S. Julio et al., "Influence of added concrete compressive strength on adhesion to an existing concrete substrate", Building and Environment 41, 2006, 1934-1939.

*Primary Examiner* — William H Mayo, III
*Assistant Examiner* — Hiram E Gonzalez
(74) *Attorney, Agent, or Firm* — Laurence Greenberg; Werner Stemer; Ralph Locher

(57) ABSTRACT

A manufacturing process for a structure having a porcelain body and a flange includes: inserting an end portion of the body into a flange opening, providing a gap between the body end portion and a metal surface of the flange, filling the gap with adhesive to create a bond between the surfaces,
(Continued)

installing an electrically active subassembly in the porcelain body and placing the structure in a heated environment to simultaneously dry the subassembly and fully cure the adhesive to provide the bond.

10 Claims, 3 Drawing Sheets

(51) Int. Cl.

| | |
|---|---|
| ***H01B 19/04*** | (2006.01) |
| ***H01F 27/32*** | (2006.01) |
| ***H01B 19/00*** | (2006.01) |
| ***H01B 3/12*** | (2006.01) |
| *H01B 17/16* | (2006.01) |

(52) U.S. Cl.
CPC ..... *H01B 19/04* (2013.01); *H01F 27/32* (2013.01); *H01B 17/16* (2013.01)

(58) Field of Classification Search
USPC ..... 156/293, 91; 174/158 R; 336/219
See application file for complete search history.

(56) References Cited

U.S. PATENT DOCUMENTS

| | | | | |
|---|---|---|---|---|
| 4,304,956 | A * | 12/1981 | Kishida | H01B 17/16 174/152 R |
| 4,791,247 | A * | 12/1988 | Cacalloro | H01B 17/303 156/245 |
| 5,340,512 | A * | 8/1994 | Slocum | B28B 17/02 249/160 |
| 5,977,487 | A * | 11/1999 | Kuhl | H01B 17/40 174/137 A |
| 8,003,891 | B2 | 8/2011 | Rocks et al. | |
| 2008/0289857 | A1* | 11/2008 | Mauroux | H01B 19/04 174/158 R |

FOREIGN PATENT DOCUMENTS

| | | |
|---|---|---|
| CN | 201340766 Y | 11/2009 |
| EP | 2203922 B1 | 11/2011 |

* cited by examiner

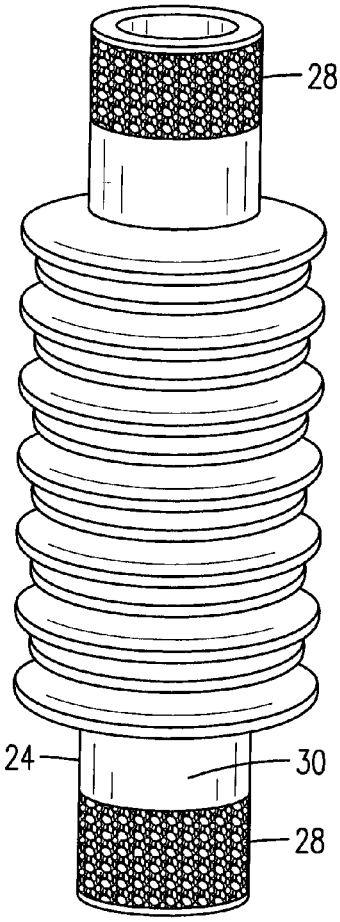
FIG. 3
FIG. 4
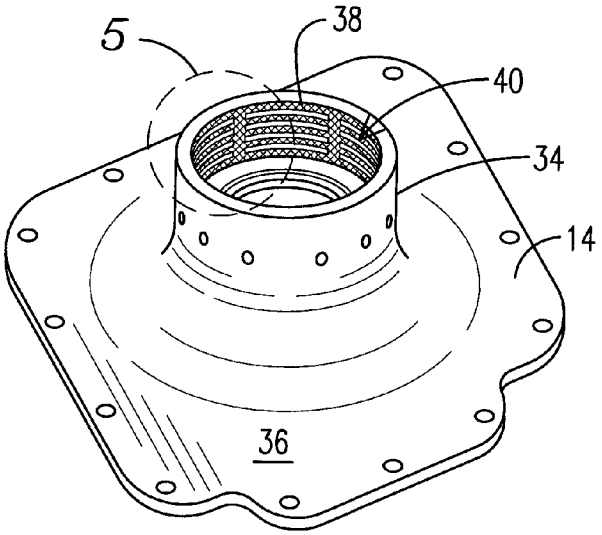
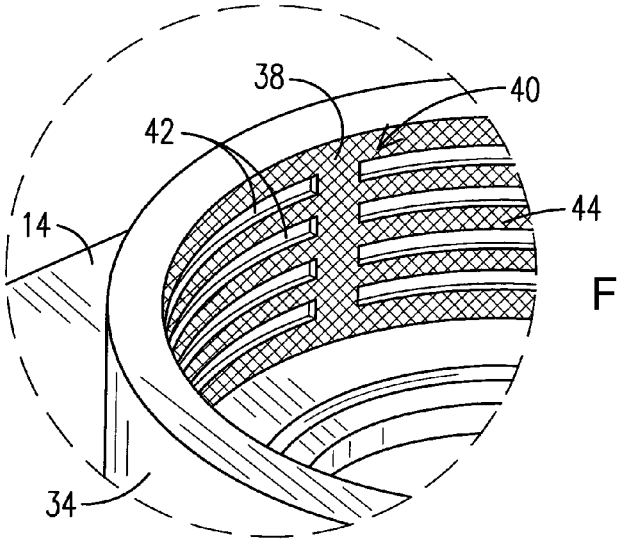
FIG. 5

METHOD OF MANUFACTURE OF PORCELAIN INSULATOR STRUCTURES AND METHOD AND ASSEMBLY FOR AFFIXING METAL FLANGES TO PORCELAIN INSULATORS

This application claims benefit of the filing date of U.S. Provisional Patent Application No. 61/586,171 filed 13 Jan. 2012.

FIELD OF THE INVENTION

This invention relates to porcelain insulator assemblies used in medium to ultra high voltage transmission applications and, more particularly, to the design and manufacture of porcelain insulator structures of the type having joints requiring high levels of mechanical stability under high load conditions experienced in a varied outdoor environment.

BACKGROUND OF THE INVENTION

Conventionally, power transmission lines with ratings ranging from medium to ultra high voltage (e.g., up to 1.2 MV or higher), use porcelain insulator assemblies to mechanically support and isolate overhead voltage lines. The assemblies may incorporate instrument transformer components. Although porcelain insulators are used in lower voltage (1 kV to 100 kV applications) the structural design considerations can differ substantially for higher voltage applications, in part because of the large physical size and increased mass of the higher voltage insulator assemblies. These assemblies are large vertical structures, essentially towers, which may extend twenty meters or more above the ground, requiring structural designs which assure enduring mechanical integrity and stability.

Porcelain insulator assemblies that operate in the high voltage regime are relatively massive structures available in numerous designs to perform a variety of functions. These functions include provision of instrument transformers or means for isolated connections to power transformers which step the voltage up or down by orders of magnitude. Generally, these such assemblies are elongate, vertically mounted structures comprising a hollow or solid glazed porcelain body having first and second open ends. The ceramic body may have a length dimension along which it extends three meters or more in height when erected above a ground plane but, more commonly, may have a length dimension extending in the range of two meters. Multiple porcelain insulator bodies are at times interconnected (end to end) to create a larger structure on the order of 15 meters in height or even taller. Typically, the insulator bodies are mounted on pedestals which may range from three to seven meters in height. Depending on the voltage rating, the larger complete structures may weigh on the order of 600 Kg or more, with individual porcelain insulator assemblies weighing about 100 Kg. Typically the fastening point between an insulator body and the pedestal is a joint subject to a significant moment. The forces encountered are especially large under wind loading because wind load typically increases as a function of height above the ground plane. Unavoidably, stresses placed on the mounting joints, that connect the relatively heavy porcelain bodies to one another or to a mounting pedestal, undergo micro movements.

A common feature of these insulator assemblies is provision of a metal attachment flange as the joint serving as a transition element from an end of a vertically oriented porcelain body to another structure. The flange interfaces a ceramic surface with a metal system to provide structural integrity to the entire assembly. The term flange, as used herein refers to a collar or a ring-shaped structure attachable to a surface, such as a metal plate, and having an opening through which a member can be inserted and attached for mounting the member to the attachable surface. In the context of the present invention, the flange opening receives and secures an end of the porcelain body and the flange is securely connected to another structure, such as the support pedestal or the high voltage line. However, an attachment flange may connect either end of the porcelain body to another porcelain body or to an intervening assembly such as a housing containing electrically active components, where the housing is positioned between porcelain bodies or between a porcelain body and a pedestal. Such intervening assemblies may be low voltage or provide current connections to equipment performing monitoring functions. In numerous applications, the attachment flange may be integrally formed with a mounting plate which can be bolted to an underlying structure such as a housing containing electrically active components. Generally, the flange serves as a transition element from a lower end of the vertically oriented porcelain body to a structural member such as the surface of the pedestal for stability.

Similarly, another attachment flange, serving as a transition element, may provide means for securing an upper end of a vertically oriented porcelain body. When multiple porcelain insulator bodies are interconnected, the connections between bodies may also be effected with pairs of connected flanges. Because of their size and the weight of these insulator assemblies, the joint between the porcelain body and the metal flange must exhibit substantial mechanical strength, especially when the structure is mounted in an outdoor environment where it may be exposed to large fluctuations in weather conditions, including wind loading, freeze-thaw cycles, or large temperature variations.

In the past, the need to provide a mechanically stable interface between the metallic and ceramic surfaces under substantial load conditions has been met with application of cement grout between mating surfaces. Generally the cement acts as a locking medium to keep flanges of the metal plates attached to the porcelain insulators. In one series of designs the mating surfaces each have features such as surface roughness or machined grooves and the cement grout extends into the surface features to provide a lock which secures the position of the porcelain end within the flange. Because the cement grout has desirable mechanical properties, but cannot bond to either of the mating surfaces, this locking arrangement has been relied upon to limit the extent to which each surface can move relative to the other surface. The cement grout normally fills all voids within the interface between the surfaces to maximize the mechanical strength of the joint being formed.

The size of the flange, the thickness of the gap between mating surfaces, and the volume of cement applied are a function of the required mechanical strength for the joint. A conventional method for attaching the flange of a metal connecting plate to the end of a porcelain body with cement grout normally includes the following steps:

1. Forming sand bands along the portion of the porcelain body which faces and mates with the metal surface, and forming relatively deep grooves along the metal surface of the flange which faces the sand bands.
2. Applying a coating material along the sand band to serve as a gasket coming into contact with the cement, as well as a cushion which compensates for effects of thermal expansion.

3. Applying a coating material along the metal surface to inhibit corrosion and to act as a second gasket as well as a cushion which compensates for effects of thermal expansion along the portion of the surface which comes into contact with the cement.
4. Bringing the surfaces together in a mating fashion with a gap between the surfaces.
5. Filling the gap with grout cement to eliminate voids. The voids being filled with the grout cement may range in width (between grooves formed along the metal surface) from 6 mm to 25 mm, or depth (based in part on groove depth) from 25 mm to 381 mm.

A critical feature of this process is formation of a specially blended grout with limitations in the size of aggregate particles. Otherwise, the grout would not be effective for completely filling small voids or gaps. It has been determined that small variations in the blending and mixing process for the grout can result in substantial degradation in mechanical strength of the resulting joint and, thus, premature failure. In fact, when mechanical strength is compromised by, for example, including too much water in the mixture, failures in the joints of such structures are known to result when the joints are subjected to freeze-thaw cycles, seismic events, wind loading, static mechanical loads or dynamic mechanical loads. Further, a lengthy curing process characteristic of Portland cement products is needed to assure integrity of the grout joint. A one week period is typically required for a sufficient partial cure, after which the joint is strong enough to tolerate modest in order to continue the manufacturing process.

A period of about one month is needed to assure a complete cure. If the assembly is moved prematurely, or if partially cured units are exposed to an excessively dry environment, the mechanical strength of the cement joint can be compromised. Similarly, use of grout which is stored in an unsuitable environment, or for too long prior to use, can also result in inferior mechanical strength.

BRIEF DESCRIPTION OF THE DRAWINGS

The invention will be better understood from the following description when read in conjunction with the accompanying drawings in which like reference numerals identify like elements throughout and wherein:

FIG. 3 more fully illustrates the porcelain insulator body shown in FIG. 2;

FIG. 4 illustrates details of the flange shown in FIG. 2; and

FIG. 5 illustrates surface features of the flange shown in FIG. 4.

Like reference characters refer to the same or similar parts throughout the different figures. The drawings are not necessarily to scale, emphasis instead having been placed on illustrating principles of the invention.

DETAILED DESCRIPTION OF THE INVENTION

Figure 1A:
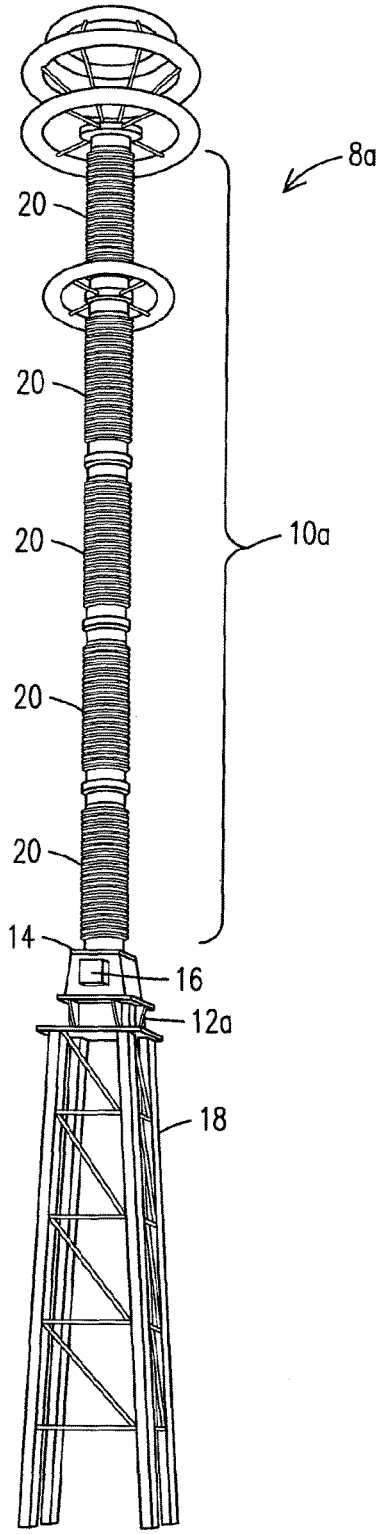
FIGS. 1A and 1B illustrate typical insulator assemblies constructed according to the invention.

According to one embodiment of the invention, there is provided an improved method and an assembly for attachment of hollow or solid porcelain insulator bodies to metal flanges. With reference to FIG. 1A, there is shown a structure SA comprising an exemplary insulator assembly 10*a* affixed to a support pedestal 12*a* via a mounting plate 14. In this example illustration the mounting plate 14 is bolted to an upper surface of a low voltage box 16 which is bolted to an upper portion of the support pedestal 18. The low voltage box provides connections to provide signals to electronic devices for protection, metering and/or communications. The insulator assembly 10 comprises a series of hollow porcelain insulator bodies 20.

Figure 1B:
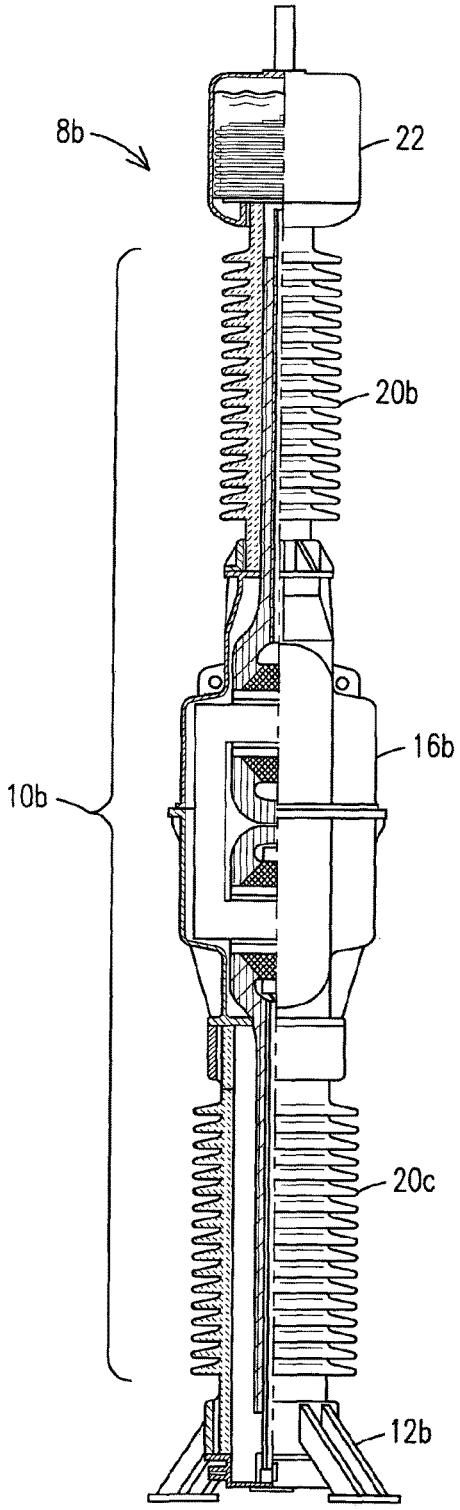

FIG. 1B illustrates an inductive voltage transformer 8*b* comprising an insulator assembly 10*b* having upper and lower porcelain insulator bodies 20*b*, 20*c* affixed to a support stand 12*b*. The upper insulator body 20*b* is a transformer which delivers a stepped down voltage to terminals in a low voltage box 16*b* positioned between the upper and lower porcelain insulator bodies 20*b*, 20*c*. An oil compensation chamber 22 is positioned above the upper insulator body 20*b*.

Figure 2:
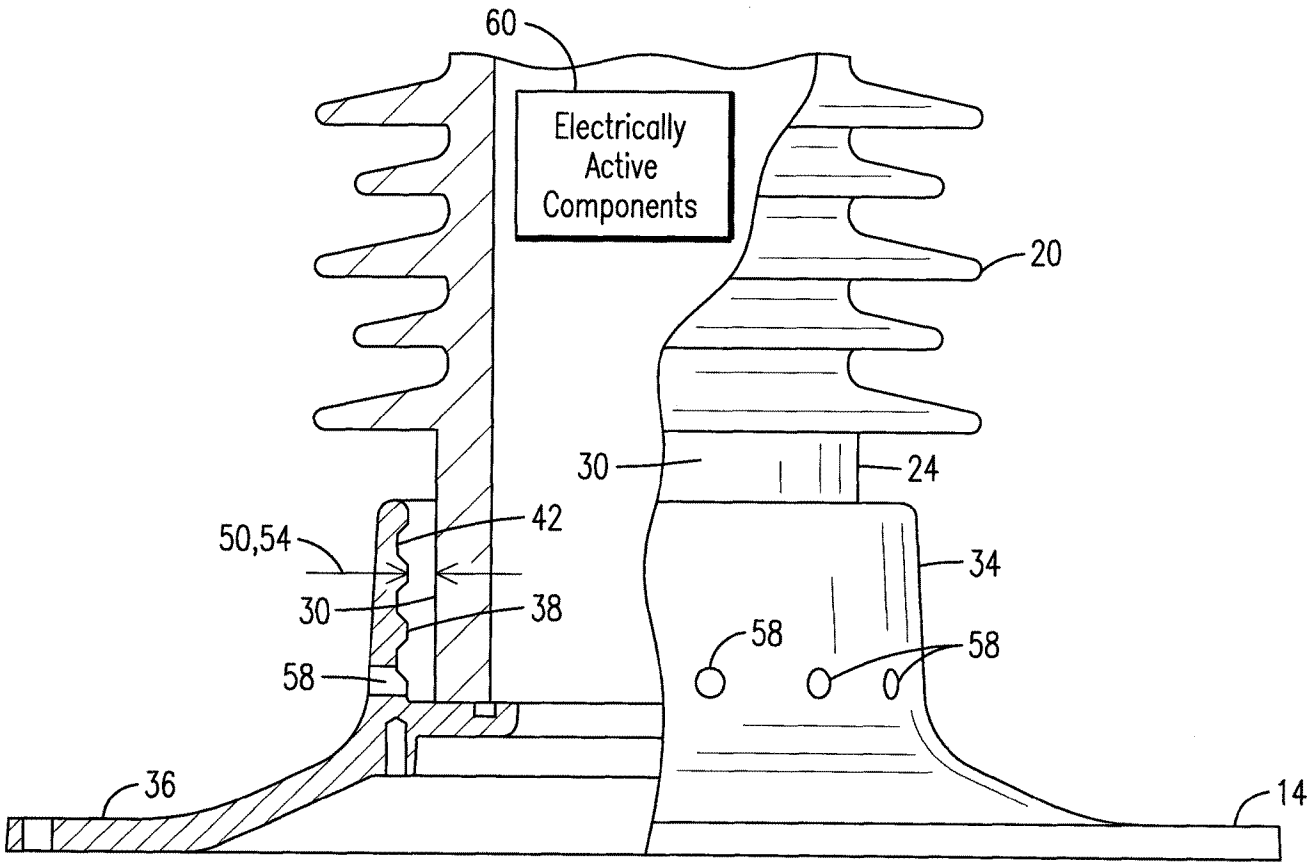
FIG. 2 is a partial cut-away view illustrating an assembly comprising an end of an exemplary porcelain insulator body coupled to an exemplary flange according to the invention.

FIG. 2 is a partial cut-away view of a lower portion of the porcelain insulator body 20 shown in FIG. 1A which, for purposes of describing the invention, can be considered equivalent to upper or lower portions of the insulator bodies 20*b* and 20*c* as now described. The insulator body 20 includes an end portion 24, cylindrical-like in shape. As further illustrated in FIG. 3, the end portion 24 has a conventional sand band 28 formed along an exterior surface 30 of the end portion 24. The mounting plate 14 shown in FIG. 1A includes a metal flange 34 extending from a surface 36 thereof to receive the end portion 24 of the insulator body 20, including the sand band.

In locations, such as between end portions 24 of connected insulator bodies 20*b* shown in FIG. 1A, the connection is effected with a pair of flanges connected back-to-back, i.e., with each flange extending in an opposite direction from a common mounting plate similar to the plate 14. With reference to FIG. 1B, in locations such as between a voltage box 16 and an end portion 24, or between an end portion 24 and either the support stand 12*b* or the expansion chamber 22, the joint comprises a flange secured to another adjoining component (e.g., the stand 12*b*) for stabilization.

As illustrated in FIG. 4, an inner cylindrical surface 38 along the opening 40 of the flange 34 has a series of grooves 42 formed therein and, as shown in the inset to FIG. 4, a machined pattern 44 providing texture. The exterior surface 30 of the end portion 24 and the inner cylindrical surface 38 of the flange 34 are mating surfaces to be bonded to one another. The sand band 28, the grooves 42 and the texture provided by the machined pattern 44 provide a desirable level of surface roughness that enhances bonding of the adhesive to each surface. These features facilitate stabilization of the bonded surfaces under load conditions.

Advantageously, the structures 8*a* and 8*b* each employ an adhesive 50 which provides both a bond between dissimilar surfaces and a locking mechanism between porcelain and metal surfaces to keep the porcelain surface secured within the metal flange, i.e., with no gaps. For a given structure, e.g., 8*a* or 8*b*, incorporation of an adhesive component, in lieu of a cement grout, results in an overall reduction in size of the flange 34 by about fifteen percent. Further, the volume of the adhesive component is reduced relative to the volume of cement grout required by conventional designs which only secure the mating surfaces 30 and 38 with a locking mechanism.

In an exemplary method, a sand band or other texture feature is formed along the surface 30 of the porcelain body 24 which faces and mates with the metal surface 38. Grooves or other texture features are formed along the metal surface 38 of the flange which faces the sand bands. The grooves do not have to be as deep as the relatively deep grooves required to create a locking mechanism or medium as required with cement grout. This feature contributes to the size reduction of the flange 34 and a reduction of the amount of adhesive needed to effect both a bond and a locking mechanism. Thus the gap 54 between the mating surfaces, shown in FIG. 2, can be reduced. FIG. 2 references the gap 54 between the mating surfaces as well as the adhesive 50 which fills the gap 54. The mating surfaces of the porcelain body and the metal flanges may be coated with a thin layer of the adhesive 50 and then assembled to bond the surfaces 30 and 38 to one another.

In another embodiment, the surfaces are assembled and the gap 54 between the mating surfaces is filled with the adhesive, e.g., via an automated dispensing process. Injection of an adhesive through ports 58 shown in FIG. 2 fills the gap 54 with the adhesive 50 in a manner which assures complete filling of all interstitial regions so there is no entrapped air between the mating surfaces. Advantageously, application of a two-part adhesive, e.g., an epoxy, enables dispensing of the adhesive on demand and according to a desired ratio of components. Initiation of polymerization can be controlled in accord with desired results.

To effect automated injection of adhesive, the filling ports 58 are formed along or near a bottom surface of the flange and adhesive is injected through the ports 58 so that adhesive flows from near the bottom of the flange and upward, facilitating removal of all air from the gap 54 between the mating surfaces. Automated processes which mix and dispense the adhesive 50 improve the overall efficiency and impart consistent mechanical strength along the interface, eliminating potential weaknesses due to operator error. Such a system can impart superior performance characteristics relative to prior systems which utilize cement grout.

Disadvantages of using the cement grout are particularly evident in systems subjected to freeze thaw cycles, seismic events, wind loading or mechanical loads. Generally, cement grouts used in this type of application do not bond to the porcelain or metal surface. The strength of the joint is largely dependent upon a mechanical locking mechanism. To assure that specifications for mechanical properties are met, the size of the joint (i.e., the size of the gap and at least the size of the flange which mates with the porcelain end region) is sized accordingly.

The adhesive 50 can be formulated to cure rapidly, relative to the cure period required for cement grouts. In one embodiment the adhesive cure period can be a few hours at room temperature. Rapid cure of the adhesive 50 to form a bond can be performed at an elevated temperature to enhance mechanical strength of the bonded arrangement. Generally, provision of an adhesive having a reduced cure period enables a faster manufacturing process. Further, with bonding characteristics realized through introduction of the adhesive material, it is possible to replace the sand bands normally positioned along the porcelain surface with a less aggressive texture or a series of grooves formed in the porcelain surface, e.g., by a machining process, thus reducing manufacturing costs, fabrication time and the amount of adhesive required to fill the gap Embodiments of the invention include a method, for attaching the flange of a metal connecting plate to the end of a porcelain body, in which neither mating surface requires application of a coating material distinct from the adhesive material. That is, a separate coating is not required to provide the function of a gasket or a compensating cushion under forces due to thermal expansion.

A feature of the invention is formulation of an adhesive material having a unique set of mechanical properties which enable replacement of relatively thick layers of the conventional cement grout. In the past, to provide necessary mechanical integrity in the afore-described porcelain-metal joints with a grout, the interface between the metal and porcelain surfaces of the joint has required relatively large gaps to accommodate relatively thick layers of the cement grout. In lieu of relying on a relatively thick layer of cement grout to assure provision of minimum mechanical strength, an adhesive is formulated to provide a relatively thin layer of material having the necessary mechanical strength. Further, because the adhesive is capable of establishing a bond between the dissimilar surfaces of porcelain and metal, the attachment system does not need to rely exclusively on a mechanical locking mechanism facilitated by provision of surface features, i.e., a sand band along the porcelain surface and a series of grooves along the metal surface.

To effect replacement of the cement grout with an adhesive in the joint between the porcelain coated body and the metal flanged plate a high voltage porcelain insulator assembly, it is necessary that the adhesive be formulated to provide suitable compressive strength as well as tensile strength and shear strength. In the past, use of adhesives in conjunction with insulator products have generally been limited to those applications requiring a minimum shear strength or characteristic tensile strength, but prior applications have typically not required formulations which primarily' provide high levels of compressive strength for structural applications. Use of an adhesive material to form a stable, durable joint under forces encountered in high voltage porcelain insulator assemblies requires properties unique to a specialized adhesive formulation. Suitable epoxy adhesives are readily obtainable, such as the Loctite® PC 9020 Nordback® Backing Compound, a product manufactured by the Henkel Corporation. 3M™ Scotch-Weld™ Epoxy products may be provided by the 3M Company. Other types of adhesives (e.g., polyurethane, polyester or other polymer) may also be used for this application.

Adhesives applied according to the invention are characterized by a minimum compressive strength of at least 60 MPa. Having a high compressive strength is important in an application, where the adhesive replaces cement grout in a high voltage porcelain insulator assembly (i) to inhibit cracking of cured adhesive under compressive loading, (ii) assure dimensional stability of the adhesive and (iii) withstand failure under thermal cycling conditions. Other desirable characteristics of the adhesive include a shear strength of at least 17 MPa, shrinkage (STM-753) of less than 3.7% by volume) and the ability to withstand degradation under a wide variety of environmental conditions (e.g., freeze-thaw cycles and temperatures ranging from −50 C. to +70 C.). The adhesive bond should have a 30 year life during which period it should withstand deterioration from uv radiation and not be susceptible to cracking or chalking. However, protection from uv damage can be had by applying a uv protective coating to exposed surfaces of the adhesive. With the flange formed of a suitable metallic material (e.g., aluminum, iron, steel), the adhesive should also be designed to exhibit a compatible coefficient of thermal expansion, i.e., to minimize differential rates of expansion between the adhesive and the flange metal during rapid or extreme temperature cycles. During fabrication of the joint, the adhesive must be capable of tolerating cure temperatures on the order of 110 C. for approximately three days to enhance mechanical properties.

With an adhesive material having these properties as well as a low pre-cure viscosity, the entire assembly process, including injection of the adhesive and cure of the joint, are suitable for automated manufacture. In this regard, another feature of the invention is provision of reduced manufacture time based on (i) the relatively short cure time for an adhesive (compared to the required cure time for a joint formed with a cement grout); and (ii) selection of a cure time and cure temperature compatible with other process steps. This enables multiple steps to be performed simultaneously and as well as automated manufacture. In contrast to these capabilities, use of Portland cement grouts has limited the ability to automate manufacture. In addition to requiring a lengthy cure time, the quality (e.g., mechanical properties) of the cured grout product has been very sensitive to minor constituent changes. On the other hand, replacement of cement grouts with adhesives renders it relatively simple and economical to provide for consistent automated mixing and use of automated dispensing machinery. Further, the cure time can be easily modified for compatibility with other process steps being performed at the same time. The cure time can be reduced based on selection of the adhesive, the mix ratio and the cure temperature.

The noted advantages are realized in manufacture of high voltage porcelain insulator assemblies such as a current transformer, a voltage transformer or a combined instrument transformer. These transformers typically have an electrically active subassembly 60 mechanically secured in the hollow region within the porcelain insulator body. See FIG. 2. A subassembly 60 comprising the electrically active components is oven or autoclave dried before or after the components are assembled in the porcelain body. Subsequently, the assembly can be placed in an oven drying unit to dry the electrically active components, before the cavity is filled with an insulating fluid and then sealed. The epoxy curing process may be performed at an elevated temperature in a convection oven or in an autoclave at a temperature in the range of 100 C. to 140 C. Exemplary conditions are 110 C. for a three day cure period. A feature of the invention is provision of an adhesive material which conforms to the above-noted specifications and also has a cure temperature rating of at least 100 C. to withstand the drying process with no degradation in adhesive properties.

With these combined features, it becomes possible to cure the adhesive material during the time period in which the drying is performed at an elevated temperature. When the uncured adhesive material has a low viscosity suitable for injection, e.g., less than 20,000 cPs, the entire manufacturing process can be automated and the manufacturing time can be substantially reduced relative to the time required for manufacture of porcelain insulator assemblies comprising porcelain metal joints formed with a cement grout.

A manufacturing process for forming a porcelain insulator structure, incorporating an adhesive material suitable for bonding an aluminum surface to porcelain, may comprise the following steps:

1. Fabrication of the porcelain hollow or solid body with an end region having an exterior surface configured for insertion within a flange connecting portion formed on a mounting plate;
2. Provision of the mounting plate with grooves formed along an interior surface of the flange connecting portion to facilitate mechanical locking between the flange interior surface and the exterior surface along the end region of the porcelain body.
3. Providing single or multiple injection ports extending from an exterior surface of the flange connecting portion through the flange to the interior surface of the flange, suitable for injecting adhesive material there through.
4. Inserting the end region of the porcelain hollow or solid body into the flange connecting portion to place the exterior surface of the porcelain body end region adjacent the interior surface of the flange with a gap between portions of the exterior surface of the porcelain body end region and the interior surface of the flange.
5. Injecting an adhesive through the port(s) to fill the gap with adhesive and fill voids between the porcelain and metal surfaces.
6. Providing a subassembly of electrically active components within a hollow region of the porcelain body.
7. Mechanically securing the subassembly in a hollow region within the porcelain insulator body before the adhesive is fully cured.
8. After partial cure of the adhesive that sufficiently stabilizes the joint for movement of the structure, placing the structure in a heated environment to simultaneously dry the electrically active components and fully cure the adhesive material.
9. Completing installation of the subassembly by providing a dielectric material in the hollow region and sealing the hollow region from the ambient environment.

There has been described a manufacturing process for forming a porcelain insulator structure, method of forming a structural joint between a porcelain insulator structure and a metal structure, and a high voltage insulator structure of the type having a structural joint between a porcelain insulator body a metal structure.

A manufacturing process for forming a porcelain insulator structure includes providing a porcelain hollow or solid body having an end region configured for connection to a flange by insertion within the flange. A metal flange has an opening for receiving the end region of the porcelain into the flange along an interior metal surface. The end region of the porcelain body is inserted into the flange opening to place an exterior surface of the porcelain body end region adjacent the interior surface of the flange with a gap between at least a portion of the exterior surface of the porcelain body end region and the interior surface of the flange. An adhesive is placed in the gap, which fills voids and creates a bond between the porcelain and metal surfaces. An electrically active subassembly is positioned in a hollow region of the porcelain hollow body. The electrically active subassembly is secured in the hollow region within the porcelain insulator body. After a partial curing of the adhesive that sufficiently stabilizes the joint for movement of the structure, the structure is placed in a heated environment to simultaneously dry the electrically active components and fully cure the adhesive to provide the bond.

A method of forming a structural joint between a porcelain insulator structure and a metal structure includes providing a porcelain body, of the type used in a high voltage transmission application, having an end region for connection to a flange by insertion within the flange. A metal flange is provided which has an opening for receiving the end region of the porcelain body. The flange includes an interior metal surface along which the end region is received. The end region of the porcelain body is inserted into the flange opening to place an exterior porcelain surface of the porcelain body end region adjacent the interior surface of the flange with a gap between a portion of the exterior surface of the porcelain body end region and the interior metal surface of the flange.

The structural joint is created by forming a bond, between the exterior surface of the porcelain body end region and the interior surface of the flange, with an adhesive placed in the gap. The adhesive is characterized by a compressive strength of at least 60 MPa to provide structural integrity to the bond.

A high voltage insulator structure, of the type having a structural joint between a porcelain insulator body and metal structure, includes a porcelain body, of the type used in a high voltage transmission application. The body includes an end region configured for connection to a flange by insertion within the flange. A metal flange has an opening for receiving the end region of the porcelain body, and includes an interior metal surface along which the porcelain body end region is positioned, thereby providing a joint between the porcelain body and the flange. An exterior porcelain surface of the porcelain body end region is adjacent the interior metal surface of the flange and there is a gap between a portion of the exterior surface of the porcelain body end region and the interior metal surface of the flange. An adhesive is positioned in the gap and extends between the exterior surface of the porcelain body end region and the interior surface of the flange to form a bond between the porcelain body end region and the flange. The adhesive is characterized by a compressive strength of at least 60 MPa to provide structural integrity to the bond.

While various embodiments of the present invention have been shown and described herein, such embodiments are provided by way of example only. Numerous variations, changes and substitutions may be made without departing from the invention herein. Accordingly, it is intended that the invention be limited only by the spirit and scope of the claims which follow.

The claimed invention is:

1. A manufacturing process for forming a porcelain insulator structure, the process comprising:

providing a porcelain hollow or solid body of a type used in a high voltage transmission application, the body having an end region configured for connection to a flange by insertion within the flange;

providing a metal flange having an opening for receiving the end region of the porcelain into the flange along an interior metal surface thereof;

inserting the end region of the porcelain body into the flange opening to place an exterior surface of the porcelain body end region adjacent the interior surface of the flange with a gap between a portion of the exterior surface of the porcelain body end region and the interior surface of the flange;

providing a sand band as a texture on the exterior porcelain surface of the porcelain body end region;

providing an adhesive in the gap which fills voids and creates a bond between the porcelain and metal surfaces;

providing said flange with one or more injection ports extending from an outer surface thereof and through said flange to provide a path for injection of said adhesive into said gap;

providing said flange with a surface texture along said interior surface of said flange that facilitates bonding of the adhesive to said flange surface and includes a series of grooves such that, in addition to providing a bond to the interior surface, said adhesive, in combination with the grooves provides mechanical locking between said flange interior surface and the exterior surface along the end region of the porcelain body;

installing a subassembly of electrically active components in a hollow region of the porcelain body;

securing the subassembly of electrically active components in a hollow region within the porcelain insulator body; and after partial curing of the adhesive that sufficiently stabilizes the joint for movement of the structure, placing the structure in a heated environment to simultaneously dry the electrically active components and fully cure the adhesive to provide the bond.

2. The manufacturing process according to claim 1, wherein the step of injection the adhesive fills all voids between the porcelain and the interior metal surface of the flange.

3. The manufacturing process according to claim 1, wherein the adhesive is selected from the group consisting of an epoxy formulation, polyurethane adhesive, a polyester adhesive and another polymeric adhesive.

4. The manufacturing process according to claim 1, wherein the step of securing the subassembly in a hollow region within the porcelain insulator body is performed while the adhesive is curing.

5. The manufacturing process according to claim 1, wherein installation of the subassembly includes providing a dielectric material in the hollow region and sealing the hollow region from the ambient environment.

6. The manufacturing process according to claim 1, wherein the steps of injecting and curing the adhesive create a structural joint by forming a bond, between the exterior surface of the porcelain body end region and the interior surface of the flange, which adhesive is characterized by a compressive strength of at least 60 MPa to provide structural integrity to the bond between the porcelain and metal surfaces.

7. A high voltage insulator structure of the type having a structural joint between a porcelain insulator body and metal structure, the insulator structure comprising:

a porcelain body of a type used in a high voltage transmission application, said body having an end region configured for connection to a flange by insertion within the flange;

a metal flange having an opening for receiving said end region of said porcelain body, said flange including an interior metal surface along which said porcelain body end region is positioned, thereby providing a joint between said porcelain body and said flange, with an exterior porcelain surface of said porcelain body end region adjacent said interior metal surface of said flange and with a gap between a portion of said exterior surface of the porcelain body end region and said interior metal surface of said flange;

said exterior porcelain surface of the porcelain body end region including a sand band providing a texture on the exterior porcelain surface of the porcelain body end region;

an adhesive disposed in said gap and extending between said exterior surface of said porcelain body end region and said interior surface of said flange to form a bond between said porcelain body end region and said flange, said adhesive being characterized by a compressive strength of at least 60 MPa to provide structural integrity to the bond;

said flange being formed with one or more injection ports extending from an outer surface thereof and through said flange to provide a path for injection of said adhesive into said gap; and said flange is formed with a surface texture along said interior surface of said flange that facilitates bonding of the adhesive to said flange surface and includes a series of grooves such that, in addition to providing a bond to the interior surface, said adhesive, in combination with the grooves, provides mechanical locking between said flange interior surface and the exterior surface along the end region of the porcelain body.

8. The high voltage insulator structure according to claim 7, wherein said porcelain body has a length dimension which extends at least two meters in height when erected above a ground plane, and said porcelain body contains a high voltage step down transformer, wherein said adhesive has a compressive strength to provide structural integrity necessary for the joint to support said porcelain body when said porcelain body is placed on a pedestal extending at least two meters in height above a ground plane in an environment subject to wind loading or seismic activity.

9. The high voltage insulator structure according to claim 7, wherein said exterior surface of said porcelain body end region includes a texture configured to facilitate adhesive bonding between said porcelain surface and said adhesive.

10. The high voltage insulator structure according to claim 7, wherein said adhesive is selected from the group consisting of an epoxy formulation, a polyurethane adhesive, a polyester adhesive and another polymeric adhesive.

* * * * *